United States Patent [19]

Iwashita et al.

[11] Patent Number: 5,037,589

[45] Date of Patent: Aug. 6, 1991

[54] METHOD OF PRODUCING MESOPHASE PITCH TYPE CARBON FIBERS AND NOZZLE FOR SPINNING SAME

[75] Inventors: Teruo Iwashita; Yutaka Arai; Hirofumi Sunago; Tadao Tomioka, all of Kawasaki, Japan

[73] Assignees: Nippon Steel Corporation; Nippon Steel Chemical Co., Ltd., both of Tokyo, Japan

[21] Appl. No.: 438,736

[22] Filed: Nov. 17, 1989

[30] Foreign Application Priority Data

| | | | |
|---|---|---|---|
| Nov. 18, 1988 | [JP] | Japan | 63-289949 |
| Nov. 18, 1988 | [JP] | Japan | 63-289950 |
| Oct. 9, 1989 | [JP] | Japan | 1-262149 |
| Oct. 9, 1989 | [JP] | Japan | 1-262150 |

[51] Int. Cl.[5] ..... D01F 9/12

[52] U.S. Cl. ..... 264/29.2; 264/211.11

[58] Field of Search ..... 264/29.2, 211.11; 425/461

[56] References Cited

U.S. PATENT DOCUMENTS

| | | | |
|---|---|---|---|
| 1,788,660 | 1/1931 | Colomb | 425/461 |
| 4,318,612 | 4/1989 | Hara et al. | 428/367 |
| 4,376,747 | 3/1983 | Nazem | 264/211.11 |
| 4,717,331 | 1/1988 | Maeda et al. | 425/467 |
| 4,816,202 | 3/1989 | Itoi | 264/211.11 |

FOREIGN PATENT DOCUMENTS

| | | | |
|---|---|---|---|
| 59-163424 | 9/1984 | Japan . | |
| 62-104927 | 5/1987 | Japan . | |
| 62-177222 | 8/1987 | Japan . | |
| 62-231022 | 10/1987 | Japan | 264/29.2 |
| 63-303118 | 12/1988 | Japan | 264/211.11 |
| 63-303121 | 12/1988 | Japan | 264/211.11 |
| WO84/03722 | 9/1984 | PCT Int'l Appl. . | |

*Primary Examiner*—Jan H. Silbaugh
*Assistant Examiner*—Brian Jones
*Attorney, Agent, or Firm*—Kenyon & Kenyon

[57] ABSTRACT

In a method of producing mesophase pitch based carbon fibers, including the steps of melt-spinning a mesophase pitch through a nozzle (1) having at least one pair of a counter-bore (2) and a circular capillary (3) to form a pitch fiber and subjecting the pitch fiber to an infusible treatment, a carbonization treatment, and if necessary, a graphitization treatment, to form a carbon fiber, the nozzle has a degree of asymmetry $\phi$ of from 0.1 to 0.9, $\phi$ being defined by the following equation $\phi = S_A/S_B$, wherein $S_A$ is an area of an inscribed circle in a contour of the cross-section of the counter-bore, which circles is perpendicular to the nozzle axis and has a center on the axis of the capillary and inscribed and $S_B$ is a total area of the cross-section of the counter-bore.

4 Claims, 4 Drawing Sheets

$$\phi = S_A / S_B$$

$$\phi = S_A / S_B$$

METHOD OF PRODUCING MESOPHASE PITCH TYPE CARBON FIBERS AND NOZZLE FOR SPINNING SAME

BACKGROUND OF THE INVENTION

1. Field of the Invention

The present invention relates to a method of producing mesophase pitch based carbon fibers and a nozzle for spinning the base pitch fibers. More specifically, it relates to a method of producing carbon fibers having no cracks along the fiber axis and having an improved mechanical strength, and a nozzle suitable for use with this method.

2. Description of the Related Arts

Carbon fibers are generally classified into two groups; PAN (polyacrylonitrile) based carbon fibers and pitch based carbon fibers. The pitch type carbon fibers drived from a mesophase pitch with a high mesophase content can have a higher modulus of elasticity.

The conventional mesophase pitch based carbon fiber usually has cracks along the fiber axis when the fiber has a higher modulus of elasticity and a high degree of graphitization. Such the carbon fiber, of course, is of little value in practical use.

The crystallite orientation of the mesophase pitch based carbon fiber in the cross-section transverse to the fiber axis (hereinafter referred to as "fiber cross-sectional structure)" varies in accordance with the spinning conditions. There are basically three types of fiber cross-sectional structure; i.e., an onion type in which a graphite crystallite is crystallized along coaxial circles in the fiber cross-section, a radial type in which the crystallites are radially oriented about the center of the fiber cross-section, and a random type in which the crystallites are distributed in a random manner without any regularities. Existing fibers, however, often have an intermediate structure in which these types are mixed. Also, there may be defects in the carbon fiber, such as, longitudinal splits, cracks or voids throughout the fiber length. Note, these various defects and fiber cross-sectional structures are closely related to the quality of the carbon fiber.

Nozzles have been proposed for obtaining pitch fibers having the onion type and random type fiber cross-sectional structures free from cracks along the fiber axis. For example, a nozzle described in Japanese Unexamined Patent Publication (Kokai) No. 59-168127 has a capillary with a cross-section widened or constricted widened at an exit thereof. Another nozzle disclosed in Japanese Unexamined Patent Publication (Kokai) No. 59-163424 has a capillary with a non-circular cross-section, by which a modified radial type or random type pitch fiber is obtained. Alternatively, U.S. Pat. No. 4,376,747 discloses a nozzle with a filter material at the upper portion of a capillary. Japanese Unexamined Patent Publication (Kokai) No. 60-259609 also discloses a nozzle with a molded element set at the upper portion of a capillary. Japanese Unexamined Patent Publication (Kokai) No. 61-258024 proposes a provision of a mesh-like layer in a region upstream of a capillary. A carbon fiber in which the degree of graphitization is restricted in the direction transverse to the fiber axis, and a process for the production thereof, are disclosed in Japanese Unexamined Patent Publication (Kokai) Nos. 62-104927 and 62-177222. According to this process, a pitch used for spinning a pitch fiber is mechanically stirred just above a capillary, by which mesophase regions are is finely divided into smaller sizes and randomly oriented. Japanese Unexamined Patent Publication (Kokai) No. 63-211325 discloses a nozzle having more than two capillaries for one counter-bore, so that a pitch flow is made turbulent and the resultant carbon fibers can be free from cracks along the fiber axis.

As stated above, there are many proposals for preventing cracks in the mesophase pitch based carbon fiber and for improving the qualities thereof. These proposals, however, have drawbacks, such as a complex nozzle structure, difficulty of uniform insertion of various tools in a plurality of counter-bores, and a lack of a uniform heat transmission, due to the formation of a large space within a nozzle. Therefore, the conventional nozzles are disadvantageous in that at least one of the spinning stability, the rigidity, the manufacturing cost, and the ease of nozzle cleaning are unsatisfactory, and cannot satisfy users' requirements.

SUMMARY OF THE INVENTION

Accordingly, an object of the present invention is to solve the problems of the prior art, such as cracks along the fiber axis due to a pure radial type fiber cross-sectional structure and due to a circumferential shrinkage when the fiber is subjected to a carbonization or graphitization treatment.

Another object of the present invention is to provide a method of producing mesophase pitch based carbon fibers, and a nozzle for spinning a pitch fiber suitable for producing the above carbon fiber, by which a good spinning stability is maintained and cleaning and regeneration of the used nozzle are easily carried out.

The present inventors studied the mechanism of the formation of the fiber cross-sectional structure of the mesophase pitch based carbon fiber, and found that the fiber cross-sectional structure varies in a wide range in accordance with a degree of asymmetry $\phi$ defined later and an ratio between cross-sections of a counter-bore and capillary. The present invention is based on this finding.

The above objects are achieved by method of producing mesophase pitch type carbon fibers, which comprises the steps of, melt-spinning a mesophase pitch through a nozzle to form a pitch fiber, and then subjecting the pitch fiber to an infusible treatment and a carbonization treatment to form a carbon fiber, characterized in that the nozzle has a degree of asymmetry $\phi$ of from 0.1 to 0.9, $\phi$ being an index representing the positional relationship between cross-sectional shapes of a counter-bore and of a capillary having a circular cross-section and defined by the following equation:

$$\phi = S_A / S_B$$

wherein $S_A$ is an area of an inscribed circle in a contour of the cross-section of the counter-bore, which circle is perpendicular to the nozzle axis, having a center on the axis of the capillary and inscribed and $S_B$ is an area of the cross-section of the counter-bore.

A filter layer may be provided in an inlet of the counter-bore.

Also, the present invention includes a nozzle having the $\phi$ value of from 0.1 to 0.9.

BRIEF DESCRIPTION OF THE DRAWINGS

The other objects and advantages of the present invention will be more apparent from the following description given with reference to drawings illustrating the preferred embodiments, wherein.

DESCRIPTION OF THE PREFERRED EMBODIMENTS

A pitch used for melt-spinning according to the present invention includes various mesophase pitches having a molecular crystallite which can be readily oriented and imparts an optical anisotropic property. A carbonaceous material used for obtaining such mesophase pitches can be, for example, coal tar pitch, petroleum heavy oil, or petroleum pitch. According to the present invention, these carbonaceous materials, after hydrogenation if necessary, are heat-treated at a temperature of from 350° C. to 500° C., preferably from 380° C. to 470° C., for a time of from 2 min to 10 hr, preferably from 5 min to 5 hr, in an inert gas atmosphere, such as nitrogen or argon, or while such a gas is blown into the material. Thereafter, volatile components in the heat-treated material are removed by a reduced pressure distillation, whereby a mesophase pitch including more than 70% of an optical anisotropic component, preferably more than 90%, is obtained, and this pitch is suitable for melt-spinning a pitch fiber to obtain a carbon fiber.

The present inventors studied the mechanism of the formation of the fiber cross-sectional structure by visualizing a flow of a mesophase pitch in a nozzle during spinning.

The flow of pitch was visualized by providing a filter just above a counter-bore within the nozzle. The network pattern of the filter remaining in the cross-section of the resultant fiber was observed by a polarization microscope, and it was found that this pattern varies by the pitch flow through the counter-bore. The filter used in this analysis was a stainless steel plain weave 400 mesh network.

Figure 3:
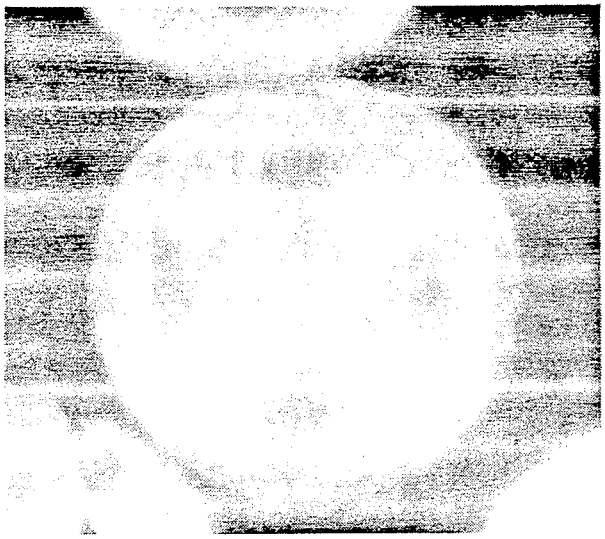
FIG. 3 is a polarization microscopic photograph, at a magnification of 340, of the cross-section of a pitch fiber obtained according to the present invention by using a nozzle having a $\phi$ value of 0.449 (from a rectangular cross-section to a circular cross-section), in which a flow of pitch is visualized by providing a 400 mesh filter above a counter-bore.
Figure 4:
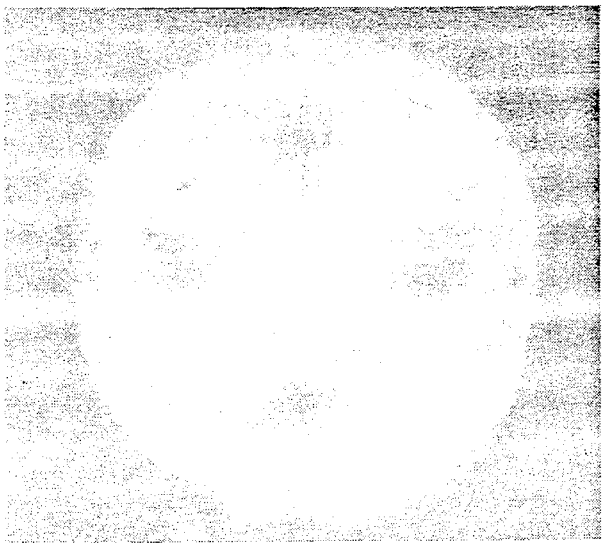
FIG. 4 is a similar photograph showing a carbon fiber of comparative example 4.

FIGS. 3 and 4 illustrate, respectively, the network pattern remaining in the cross-section of the pitch fiber, wherein FIG. 3 is the cross-section of the fiber obtained from a nozzle according to the present invention; this nozzle having a rectangular cross-sectional counter-bore and a circular cross-sectional capillary, and the capillary is positioned at a central point of the rectangular cross-section of the counterbore, as shown in FIG. 1(*a*). The nozzle also has a $\phi$ value of 0.449. The "central point" defined in this specification stands for the inner center in the case of a triangular cross-section and the center of gravity in the case of a polygonal cross-section. The network pattern shown in this fiber cross-section is very special. That is, the network pattern is heavily distorted in the fiber cross-section to form steeply curved pattern lines. Namely, this pattern represents a state in which the rectangular cross-section of the counter-bore is projected on the circular cross-section of the capillary, while reducing the size and deforming the shape thereof. Surprisingly, even when using a nozzle in which the counter-bore and capillary both have a circular cross-section ($\phi=0.25$) as shown in FIG. 1(*g*), the resultant fiber had a cross-sectional structure including steeply curved pattern lines.

FIG. 4 is a cross-section of a pitch fiber obtained from a conventional spinning nozzle having a $\phi$ value of 1.0, and both the counter-bore and capillary thereof having a circular cross-section. The network pattern shown in the fiber cross-section substantially consists of straight lines and hardly has steeply curved pattern lines. This network pattern is the same as disclosed in U.S. Pat. No. 4,818,612. The difference between FIGS. 3 and 4 teaches that it is possible to obtain a mesophase pitch fiber having a fiber cross-sectional structure of the modified radial type or the random type with steeply curved pattern lines, by making the cross-section of counter-bore non-circular and/or by deviating the position of the capillary from the central point of the cross-section of the counter-bore. Namely, these photographs show that the cross-sectional shape of the counter-bore and the position of the capillary are important factors in the control of the formation of the cross-sectional structure of the mesophase pitch fiber.

It is surmised that the pitch flow through the counter-bore during the spinning operation may play an important role in constructing the fiber cross-sectional structure. The more distorted pitch flow through the counter-bore results in more distorted fiber cross-sectional structure. To what extent the pitch flow is distorted is essentially defined by the degree of asymmetry $\phi$. Further, the smaller $\phi$ results in the finer division of graphite crystallite size in the carbon fiber.

Figure 1A:
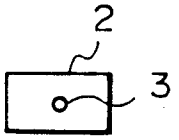
FIGS. 1(*a*) through 1(*i*) illustrate, respectively, an example of the cross-sectional shape of counter-bore and an example of the positional relationship between a counter-bore and a capillary.
Figure 1B:
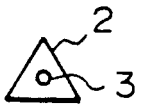
Figure 1C:
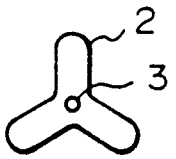
Figure 1D:
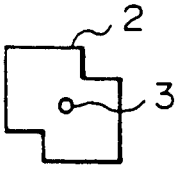
Figure 1E:
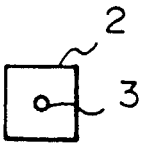
Figure 1F:
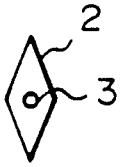
Figure 1G:
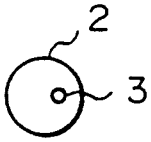
Figure 1H:
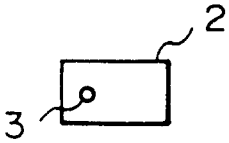
Figure 1I:
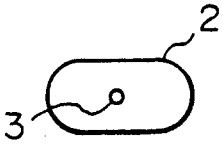
Figure 2A:
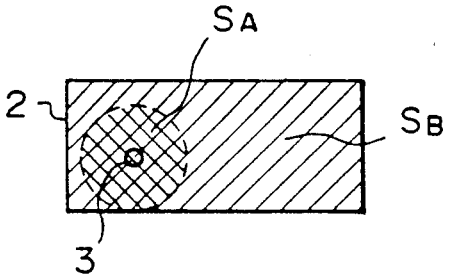
FIGS. 2(*a*) through 2(*c*) illustrate, respectively, an example of a definition of the degree of asymmetry $\phi$.
Figure 2B:
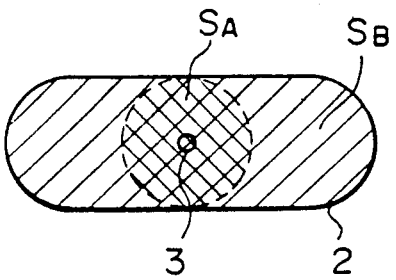
Figure 2C:
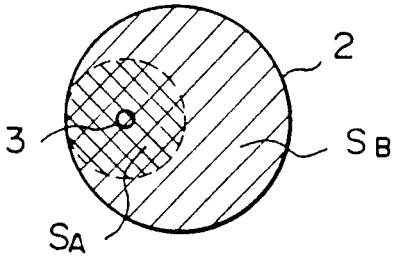

The degree of asymmetry $\phi$ is defined geometrically from the cross-sectional shape of the counter-bore and the position of the capillary relative to the counter-bore. That is, $\phi$ is defined as a ratio between a cross-sectional area of the counter-bore and an area of a circle inscribed in the cross-section of the counter-bore and having a center coinciding with the axis of the capillary. This circle has a radius corresponding to the minimum distance between any part of the inner wall of the counter-bore and the center of the capillary. The above definition of $\phi$ will be more clearly understood by reference to FIGS. 2(*a*) through 2(*c*), in which $\phi$ is defined by $S_A S_b$, wherein $S_a$ stands for an area of the above circle and $S_B$ stands for the cross-sectional area of the counter-bore.

The degree of asymmetry $\phi$ is a measure representing the asymmetrical deformation of a pitch flow from the counter-bore to the capillary.

According to the present invention, the $\phi$ value should be from 0.1 to 0.9, preferably from 0.1 to 0.8. If the $\phi$ value exceeds 0.9, a favorable result cannot be expected because the asymmetrical deformation of the pitch flow is small. Conversely, if the $\phi$ value is smaller than 0.1, the mechanical strength of the resultant fiber is lowered. The reason therefor is not apparent, but it is surmised that the asymmetrical deformation of the pitch flow is too great to obtain a suitable fiber cross-sectional structure of the resultant fiber or that the asymmetrical disposition of the counter-bore and the capillary cannot be properly reflected at the deformation of the pitch flow.

In addition to the position of the capillary in the cross-section of the counter-bore, the cross-sectional shape of the counter-bore is another important factor when deciding a suitable $\phi$ value. According to the present invention, the degree of circularity is introduced as a measure for representing the cross-sectional shape of the counter-bore. The concept of the degree of circularity is disclosed in "Powder Technology" p.73 (published in 1972 from ASAKURA SHOTEN, Japan); this concept was first introduced by Wadell in 1933 and referred to as a "perimeter ratio". The degree of circularity $D_c$ is a peripheral length LC of a circle having the same area as a projected area of a particle divided by a peripheral length LP of the projected area of the particle. The cross-sectional shape of the counter-bore used for the present invention preferably has a degree of circularity $D_c$ of not more than 0.9, more preferably not more than 0.88.

The possible cross-sectional shape of counter-bore and the possible positional relationship between the counter-bore and the capillary satisfying the $\phi$ value in a range defined according to the present invention will be explained below.

(1) The cross-sectional shape of the counter-bore is non-circular and the circular capillary is positioned to coincide with the central point of the cross-section of the counter-bore, (2) the cross-sectional shape of the counter-bore is non-circular and the circular capillary is at a position deviated from the central point of the cross-section of the counter-bore, and, (3) the cross-sectional shape of the counter-bore is circular and the circular capillary is at a position deviated from the central point of the cross-section of the counter-bore.

One capillary corresponds to one counter-bore in the present invention, and this is important to a maintaining of the uniformity of the fiber cross-sectional structure, a stable spinning operation, and a uniform heat-transmission on the nozzle surface, as well as for imparting a rigidity to the nozzle against the spinning pressure.

In addition, the larger the ratio $S_{CB}/S_{CP}$, the greater the distortion of the pitch flow through counter-bore, wherein $S_{CB}$ and $S_{CP}$ stand for, respectively, the cross-sectional area of the counter-bore and that of the capillary. Visualization of the mesophase pitch flow through the counter-bore showed that the curvature of the network pattern line in the fiber cross-sectional structure becomes steep as this ratio is increased, and the modified radial type or random type cross-sectional structure can be formed, and thus cracks along the fiber axis after graphitization of the pitch fiber can be avoided.

For example, according to the photograph of FIG. 3, a space remaining between the network pattern lines in the fiber cross-sectional structure exactly coincides with a space in the network pattern of the existing filter (400 mesh) reduced in size by 1/20, and in addition, a square root of the cross-section area of the pitch fiber thus obtained precisely coincides with a square root of that of the counter-bore divided by 20. This number corresponds to a ratio between cross-sectional areas of the counter-bore and the capillary. This shows that the steep distortion of the pitch flow is resulted from the constriction effect based on the actual ratio between the cross-sections of the counter-bore and capillary, as well as to the asymmetrical relationship between the cross-sectional shapes thereof. It is surmised that, according to these effects, the division of the graphite crystallite is enhanced.

Preferably, the ratio $S_{CB}/S_{CP}$ is from 50 to 2500, more preferably from 100 to 2500, to obtain a mesophase pitch fiber having the fiber cross-sectional structure with steeply curved pattern lines. If higher than 2500, the number of counter-bores formed in the nozzle body is extremely limited, or the capillary becomes too thin to be machined and the nozzle rigidity against spinning pressure is not sufficient. Conversely, if the ratio is less than 50, the deformation of the pitch flow is insufficient.

In an aspect of the present invention, the pitch may be introduced into the counter-bore having a $\phi$ value of from 0.1 to 0.9 through a filter layer, and thereafter guided to the circular capillary.

A plain weave network, a thin metal plate or foil with a plurality of small holes may be used as a filter.

The filter disposed at the inlet of the counter-bore may enhances the fine division of the graphite crystallite size in the carbon fiber. However, such the fine division is mainly achieved by the effect of increased degree of asymmetry $\phi$ in the present invention.

The present invention will be described in more detail with reference to the following preferred

EXAMPLES AND A COMPARISON WITH COMPARATIVE EXAMPLES

In these Examples or comparative Examples, % is a weight % except for the content of the mesophase pitch stated later, which represents an areal ratio.

The characteristics of a carbon fiber listed in the Tables were measured in the following manner:

(1) Tensile strength

Measurement was conducted in accordance with JIS R 7601

(2) Viscosity and softening point

Viscosity was determined by an equation of Hagen-Poiseuille based on data collected through a flow tester. The softening point was defined as a temperature at which the viscosity is 20,000 poise.

(3) Content of mesophase component

In this specification, "mesophase" stands for an optical anisotropic portion which can be detected by observation with a polarization microscope on a polished surface of solidified pitch embedded in a resin. The content of the mesophase component is defined as a ratio of the detected mesophase area relative to the total observed area.

EXAMPLES 1 THROUGH 7

Coal tar pitch having a softening point of 22° C. was heated to 200° C. and filtered to remove a quinoline isoluble component. The pitch was then directly hydrogenized in the presence of a Co-Mo catalysis, under the conditions of an LHSV (liquid hourly space velocity) of 1.7, a reaction temperature of 350° C., and a reaction pressure of 120 atm. Thereafter, lighter components were removed. The residual pitch exhibited a softening point of 90° C. and had a toluene insoluble component of 4%, and a trace quinoline isoluble component. Finally the pitch was heat-treated at a temperature of 470° C. at an atmospheric pressure to remove the components having a lower boiling point. The resultant mesophase pitch had exhibited a softening point of 300° C. and had a toluene isoluble component of 85%, a quinoline insoluble component of 14%, and a content of mesophase component of 95%.

Figure 5:
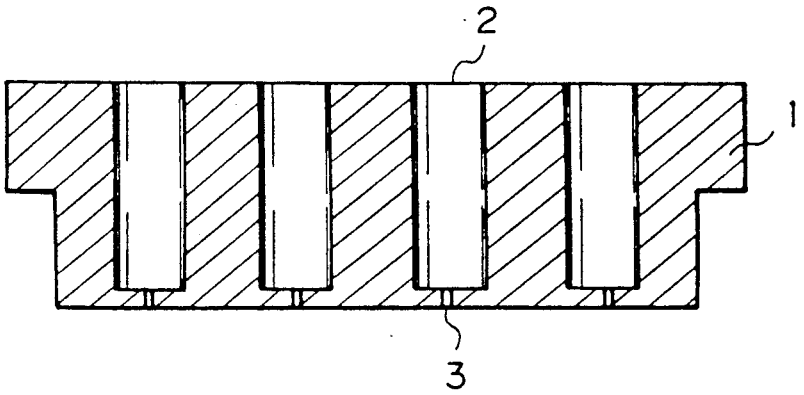
FIG. 5 illustrates a side sectional view of a nozzle according to the present invention.

Melt-spinning tests were conducted in Examples 1 through 7 with this mesophase pitch through spinning nozzles of a type similar to that illustrated in FIG. 5. Each nozzle was provided with 100 pairs of counter-bores and capillaries, each having the relationship as illustrated in FIG. 1. The spinning conditions were such that a spinning temperature was maintained at from 340° C. to 360° C. and a pitch flow rate was 0.05 g/min per capillary. The $\phi$ values, the degrees of circularity $D_C$, and the actual ratio between cross-sections of counter-bore and capillary $S_{CB}/S_{CP}$ are listed in Table 1. In each spinning test, a pitch fiber having a diameter of 12 μm was smoothly and stably spun for a long time at a take-up speed of 340 m/min and at an optimum spinning temperature.

The resultant pitch fibers were subjected to an infusible treatment in which the fiber was heated in air at from 200° C. to 300° C. at a rate of 0.5° C./min and kept at the final temperature for 1 hour. Then the infusible pitch fiber was subjected to a carbonization treatment in an argon gas atmosphere to form a carbon fiber, in which the temperature was elevated to 2300° C at a rate of 50° C./min and kept at the final temperature for 15 min. Measurements were conducted on the carbon fiber thus obtained with regard to the tensile strength and tensile modulus of elasticity. Further, a fiber cross-sectional structure was observed with a polarization microscope and a scanning electron microscope. The results are shown in Table 1.

COMPARATIVE EXAMPLES 1 THROUGH 3

Figure 7:
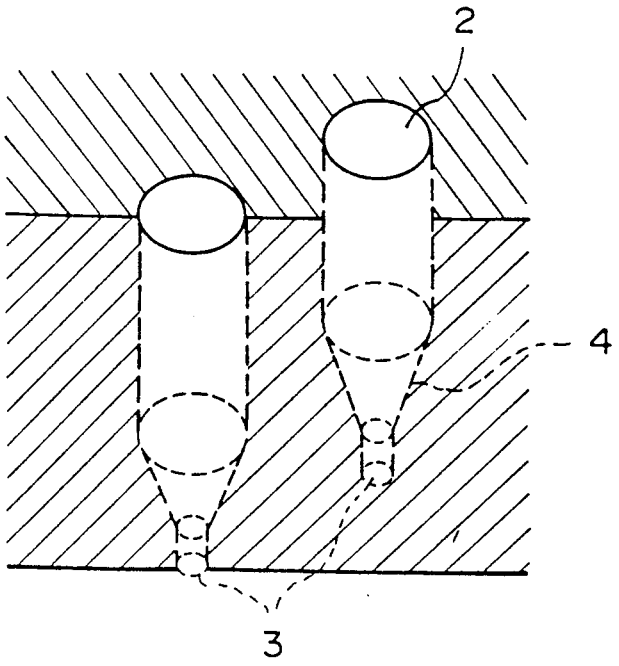
FIG. 7 schematically illustrates the structure of a conventional nozzle, wherein reference numeral 1 refers to a nozzle, 2 to an inlet of a counter-bore, 3 to a capillary, 4 to an approach, and 5 to a filter layer.

Melt-spinning tests were conducted in Comparative Examples 1 and 2 with the mesophase pitch used in Example 1 under the same spinning conditions through two conventional nozzle of the type similar to that illustrated in FIG. 7, which has 100 pairs of counter-bores and circular capillaries respectively positioned at the center of the corresponding counter-bore. In other words, the $\phi$ value was 1.0. The capillary diameters of the two nozzles were different, but the counter-bores of the two nozzles were equal in size to each other; a cross-sectional diameter of 3.0 mm, a depth of 10 mm, and an approach angle of 90° C.

A similar spinning test was conducted in Comparative Example 3 through another nozzle having the same shape and dimensions as that used in Example 6, except that the $\phi$ value was 0.0031.

In the respective spinning test, a pitch fiber having a diameter of 12 μm was smoothly and stably spun for a long time at a take-up speed of 340 m/min and at an optimum spinning temperature.

The resultant pitch fibers were subjected to an infusible treatment and carbonization treatment in the same manner as in Example 1, and the results are shown in Table 1.

As apparent from the Table, carbon fibers obtained from Examples 1 through 7 according to the present invention have a high tensile strength, and a fiber cross-sectional structure thereof is a modified radial type in which the orientation of graphite crystallites is steeply curved, or is random type, and free from cracks along the fiber axis. On the contrary, carbon fibers obtained from Comparative Example 1 and 2 using a nozzle having a $\phi$ value of 1.0 are of a pure radial type and many wedge-shaped cracks are observed along the fiber axis. Although a carbon fiber obtained from Comparative Example 3 using a nozzle having a $\phi$ value of 0.0031 has no cracks along the fiber axis, it has a lower tensile strength than those of the present invention.

TABLE 1

| | Item | | | | | | | | |
|---|---|---|---|---|---|---|---|---|---|
| | Spinning Nozzle | | | | | Carbon Fiber | | | |
| Run | Counter-bore Cross-section | $\phi$ | $D_c$ | Dia. of Capillary (mm) | $S_{CB}/S_{CP}$ | Tensile Strength (kg/mm$^2$) | Modulus (ton/mm$^2$) | Fiber Cross-Sectional Structure | Cracks |
| Example 1 | Rectangular | 0.449 | 0.853 | 0.14 | 454 | 310 | 43 | Modified radial type | none |
| Example 2 | Triangular | 0.604 | 0.785 | 0.30 | 100 | 305 | 42 | Modified radial type | none |
| Example 3 | Square | 0.785 | 0.872 | 0.30 | 100 | 290 | 44 | Modified radial type | none |
| Example 4 | Y-shaped | 0.468 | 0.729 | 0.14 | 501 | 313 | 42 | Random type | none |
| Example 5 | Rectangular | 0.449 | 0.853 | 0.30 | 107 | 285 | 44 | Modified radial type | none |
| Example 6 | Circular | 0.250 | 1.00 | 0.14 | 319 | 324 | 43 | Modified radial type | none |
| Example 7 | Oval | 0.338 | 0.756 | 0.14 | 432 | 320 | 42 | Modified radial type | none |
| Comparative Example 1 | Circular | 1.00 | 1.00 | 0.14 | 454 | 205 | 42 | Radial type | existence |
| Comparative Example 2 | Circular | 1.00 | 1.00 | 0.30 | 100 | 220 | 41 | Radial type | existence |
| Comparative Example 3 | Circular | 0.0031 | 1.00 | 0.14 | 319 | 247 | 42 | Modified radial type | none |

EXAMPLES 8 THROUGH 11

Figure 6:
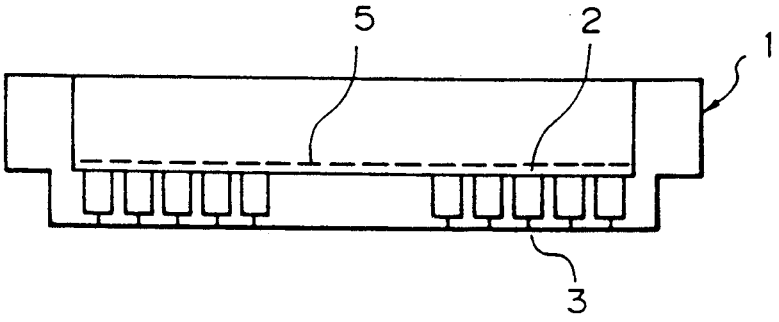
FIG. 6 illustrates a side sectional view of a nozzle according to the present invention, with a filter arranged above a group of capillaries.

Melt-spinning tests were conducted in Examples 8 through 11 with the mesophase pitch used in Example 1 through spinning nozzles of the type illustrated in FIG. 6 provided with a 400 mesh filter layer above a row of counter-bores and each provided with 100 pairs of counter-bores and capillaries illustrated in FIG. 1 having a $\phi$ value within the present invention. The degree of asymmetry $\phi$, the degree of circularity $D_C$, the actual ratio between the cross-sections of counter-bore and capillary $S_{CB}/S_{CP}$, and the residence time of pitch in a counter-bore are shown in Table 2.

In each case, the spinning was smoothly and stably carried out as those in Examples 1 through 7.

A pitch fiber having a diameter of 12 μm was obtained and was subjected to an infusible treatment and a carbonization treatment in the same manner as in the case of Example 1. Measurements were carried out on the resultant carbon fibers with regard to the tensile strength, the tensile modulus of elasticity, and $L_C$(002), which is the graphite crystallite size measured by X-ray diffraction technique, and the results are shown in Table 2. Further, the fiber cross-sectional structure was observed by a polarization microscope and a scanning type electron microscope, and the results are also shown in Table 2. In Table 2, the results obtained in Example 1 are shown again for a comparison of a with-filter and a without-filter processes.

TABLE 2

| | Item | | | | | | | | | | | |
|---|---|---|---|---|---|---|---|---|---|---|---|---|
| | Spinning Nozzle | | | | | | | Carbon Fiber | | | | |
| Run | Filter layer | Counter-bore Cross-section | $\phi$ | $D_c$ | Dia. of Capillary (mm) | $S_{CB}/S_{CP}$ | Residence Time (sec) | Tensile Strength (kg/mm$^2$) | Modulus (ton/mm$^2$) | Lc(002) (nm) | Fiber Cross-Sectional Structure | Cracks |
| Example 8 | existence | Rectangular | 0.449 | 0.853 | 0.14 | 454 | 46 | 334 | 43 | 16.9 | Modified radial type | none |
| Example 9 | existence | Triangular | 0.604 | 0.785 | 0.30 | 100 | 46 | 330 | 42 | 16.8 | Modified radial type | none |
| Example 10 | existence | Square | 0.785 | 0.872 | 0.20 | 230 | 46 | 313 | 43 | 17.3 | Modified radial type | none |
| Example 11 | existence | Circular | 0.250 | 1.00 | 0.14 | 319 | 46 | 358 | 43 | 15.3 | Modified radial type | none |
| Comparative Example 4 | existence | Circular | 1.00 | 1.00 | 0.14 | 454 | 46 | 254 | 43 | 18.5 | Radial type | none |
| Example 1 | none | Rectangular | 0.449 | 0.853 | 0.14 | 454 | — | 310 | 43 | 20.7 | Modified radial type | none |
| Comparative Example 1 | none | Circular | 1.00 | 1.00 | 0.14 | 454 | — | 205 | 42 | 21.6 | Radial type | existence |

COMPARATIVE EXAMPLE 4

A spinning test was carried out in Comparative Example 4 with the mesophase pitch used in Example 1, through a spinning nozzle of the conventional type illustrated in FIG. 6 provided with 100 pairs of circular counter-bores and capillaries. A 400 mesh filter layer was provided above a row of the counter-bores. The counter-bores had a cross-sectional diameter of 3.0 mm and a depth of 5 mm, and the spinning conditions were the same as in Example 1.

The spinning was smoothly and stably carried out, and a pitch fiber having a diameter of 12 $\mu$m was obtained and subjected to an infusible treatment and a carbonization treatment in the same manner as in the case of Example 1. Measurements were carried out on the resultant carbon fibers with regard to the tensile strength, the tensile modulus, and the $L_C$ (002). The results are shown in Table 2. Further, the fiber cross-sectional structure was observed by a polarization microscope and a scanning type electron microscope, and the results are also shown in Table 2. In Table 2, the results obtained in Comparative Example 1 are again shown, for a comparison of the with-filter and without-filter processes.

As apparent from Table 2, the mechanical properties of the carbon fiber obtained by the present invention are obviously improved.

EXAMPLES 12 AND 13

Pitch fibers obtained in Examples 8 and 11 were subjected to an infusible treatment in air containing 5% nitrogen dioxide gas, in which the fibers are heated from 200° C. to 300° C. at a constant rate of 10°C./min and kept at the final temperature for 30 min. Then the infusible fibers were subjected to a carbonization treatment in an argon gas atmosphere to form carbon fibers, wherein the temperature was elevated to 2300° C. at a rate of 50°C./min and kept at the final temperature for 15 min. Measurements were made on the carbon fibers thus obtained with regard to the tensile strength, the tensile modulus, and the fiber cross-sectional structure thereof, and the results are shown in Table 3.

COMPARATIVE EXAMPLE 5

A pitch fiber obtained in Comparative Example 4 was subjected to an infusible treatment and a carbonization treatment in the same manner as in Example 12, and similar measurements were made of on the carbon fiber thus obtained. The results are shown in Table 3.

As apparent from this Table, the mechanical properties of the carbon fibers are generally improved by the infusible treatment using nitrogen dioxide gas, but the present invention provides better mechanical properties than the conventional method.

TABLE 3

| | Item | | | | | | | | |
|---|---|---|---|---|---|---|---|---|---|
| | Spinning Nozzle | | | | | | Carbon Fiber | | |
| Run | Counter-bore Cross-section | $\phi$ | $D_c$ | Dia. of Capillary (mm) | $S_{CB}/S_{CP}$ | Residence Time (sec) | Tensile Strength (kg/mm$^2$) | Modulus (ton/mm$^2$) | Fiber Cross-Sectional Structure | Cracks |
| Example 12 | Rectangular | 0.449 | 0.853 | 0.14 | 454 | 46 | 405 | 46 | Modified radial type | none |
| Example 13 | Circular | 0.250 | 1.00 | 0.14 | 319 | 46 | 425 | 45 | Modified radial type | none |
| Comparative Example 5 | Circular | 1.00 | 1.00 | 0.14 | 454 | 46 | 327 | 43 | Radial type | none |

As stated above, according to the present invention, since a flow of mesophase pitch introduced into a counter-bore and flowing toward a capillary is asymmetrically and/or non-uniformly constricted during the spinning through the counter-bore, the resultant pitch fiber has a fiber cross-sectional structure of a modified radial type, in which graphite crystallites are oriented in a curved manner or of a random type. This produces a carbon fiber free from wedge-shaped cracks along the fiber axis and having improved mechanical properties.

Since the cross-section of the capillary is circular, the spinning operation is smoothly and stably continued for a long time. Further, the structure of the nozzle is simple, and cleaning and regeneration thereof are easily and quickly carried out.

What is claimed is:

1. A method of producing mesophase pitch type carbon fibers with improved properties, comprising the steps of melt-spinning a mesophase pitch through a nozzle with at least one pair of a counter-bore and a circular capillary to form a pitch fiber and subjecting the formed pitch fiber to an infusible treatment and a carbonization treatment to form a carbon fiber, the improvement comprising the nozzle having a degree of asymmetry $\phi$ of from 0.1 to 0.9, $\phi$ being defined by the following equation:

$$\phi = S_A/S_b$$

wherein $S_A$ is an area of an inscribed circle in a contour of the cross-section of the counter-bore, which circle is perpendicular to the nozzle axis and has a center on the axis of the capillary, and $S_B$ is an area of the cross-section of the counter-bore.

2. A method as defined in claim 1, wherein the nozzle has a ratio $S_{CB}/S_{CP}$ of from 50 to 2500, wherein $S_{CB}$ and $S_{CP}$ stand for, respectively, the cross-sectional area of the counter-bore and that of the capillary.

3. A method as defined in claim 1 or 2, wherein a filter layer is provided at an inlet of the counter-bore.

4. A method according to claim 1 which further includes subjecting the fiber to a graphitization treatment.

* * * * *

UNITED STATES PATENT AND TRADEMARK OFFICE

CERTIFICATE OF CORRECTION

PATENT NO. : 5,037,589

DATED : August 6, 1991

INVENTOR(S) : Teruo IWASHITA, et al.

It is certified that error appears in the above-identified patent and that said Letters Patent is hereby corrected as shown below:

Column 4, line 16, before "cross-sectional" insert --favorable fiber--.

Column 4, line 58, change "$S_AS_b$" to --$S_AS_B$-- and "$S_a$" to --$S_A$--.

Column 6, lines 33 and 34 should continue on to line 32 as follows:

"with reference to the following preferred Examples and a comparison with Comparative Examples."

Column 12, line 4, change ".../$S_b$" to --.../$S_B$--.

Signed and Sealed this

Twenty-first Day of December, 1993

Attest:

Bruce Lehman

BRUCE LEHMAN

Attesting Officer

Commissioner of Patents and Trademarks